United States Patent [19]

Nelson

[11] Patent Number: 4,496,127

[45] Date of Patent: Jan. 29, 1985

[54] ADJUSTABLE BOOK HOLDER INCLUDING MAGNIFYING FRONT PANEL

[76] Inventor: M. Gene Nelson, 4414 N. 21st Ave., Phoenix, Ariz. 85015

[21] Appl. No.: 397,030

[22] Filed: Jul. 12, 1982

[51] Int. Cl.[3] ..... A47B 97/00

[52] U.S. Cl. ..... 248/441.1; 40/10 D; 40/152.1; 211/43

[58] Field of Search ..... 248/448, 450, 456, 441.1, 248/451, 460, 316.6, 454; D19/91; D6/180, 184; 40/10 D, 152.1; 235/70 B; 211/42, 43, 49 R

[56] References Cited

U.S. PATENT DOCUMENTS

| | | | |
|---|---|---|---|
| 1,424,807 | 8/1922 | Dieckmann | 235/70 B |
| 1,750,575 | 3/1930 | Cubberley | 211/43 X |
| 1,750,576 | 3/1930 | Cubberley | 211/43 X |
| 2,419,721 | 4/1947 | Kopp | 211/43 X |
| 2,434,860 | 1/1948 | Oxley | 40/152.1 X |
| 2,533,628 | 12/1950 | Rosenberg | 235/70 B |
| 3,338,629 | 8/1967 | Drees | 248/451 X |
| 3,455,462 | 7/1969 | Morgan | 211/42 |
| 3,762,675 | 10/1973 | Sankey | 248/464 |
| 3,809,352 | 5/1974 | Mathias | 248/451 |

FOREIGN PATENT DOCUMENTS

| | | | |
|---|---|---|---|
| 338287 | 6/1959 | Switzerland | 211/42 |

*Primary Examiner*—Ramon S. Britts
*Assistant Examiner*—Sarah A. Lechok
*Attorney, Agent, or Firm*—Cahill, Sutton & Thomas

[57] ABSTRACT

An adjustable book holder for supporting a book or the like in an opened position includes a front member having a horizontal base portion and a transparent support panel extending upwardly and rearwardly from the front end of the horizontal base portion. The book holder also includes a rear member having a horizontal base portion and a support panel extending upwardly and rearwardly from the front end of the base portion of the rear member. The lower surface of the base portion of the rear member includes a toothed rack which releasably engages a mating toothed rack provided by the upper surface of the base portion of the front member for positioning the support panel of the rear member generally parallel to the support panel of the front member and spaced apart therefrom by a distance that is adjustable to account for books of different thicknesses. The transparent support panel of the front member is preferably formed as a magnifying lens to enlarge the printed matter appearing upon the exposed pages of the book.

7 Claims, 4 Drawing Figures

FIG-1
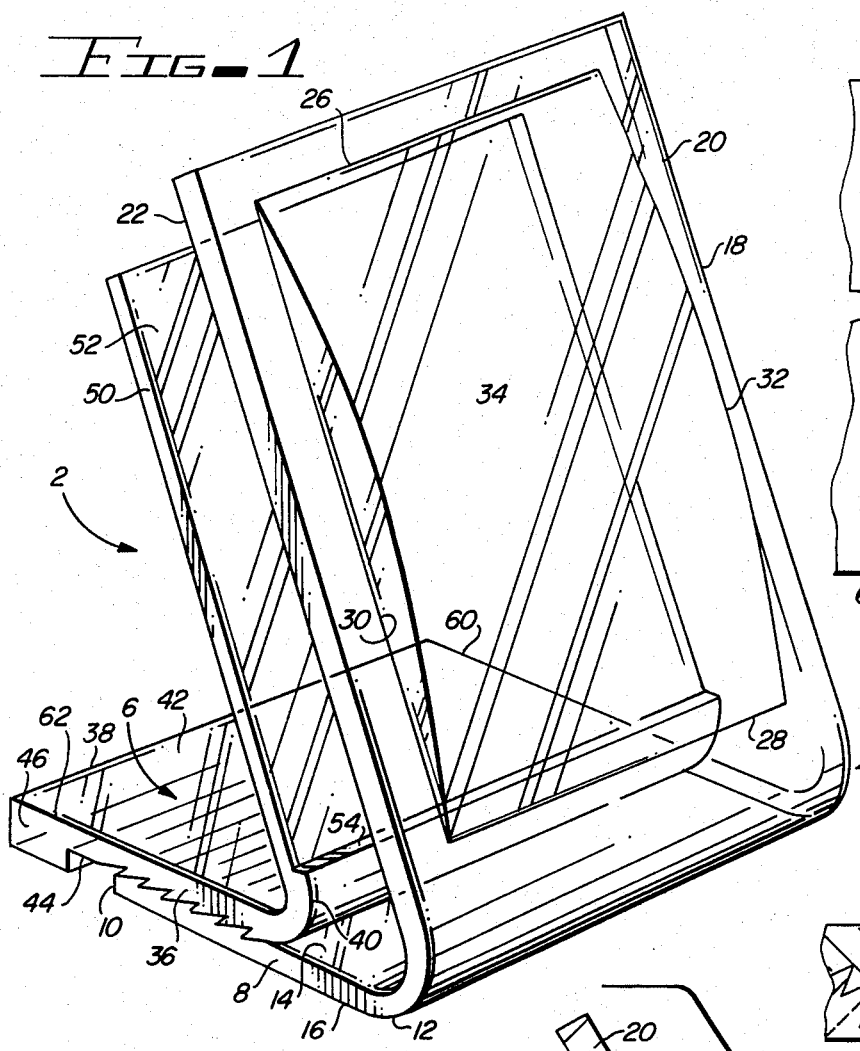
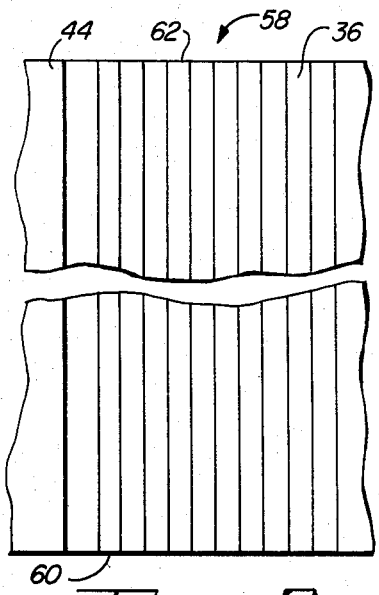
FIG-3
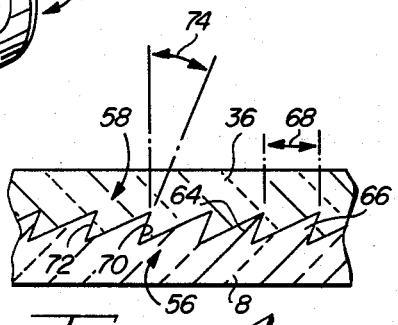
FIG-4
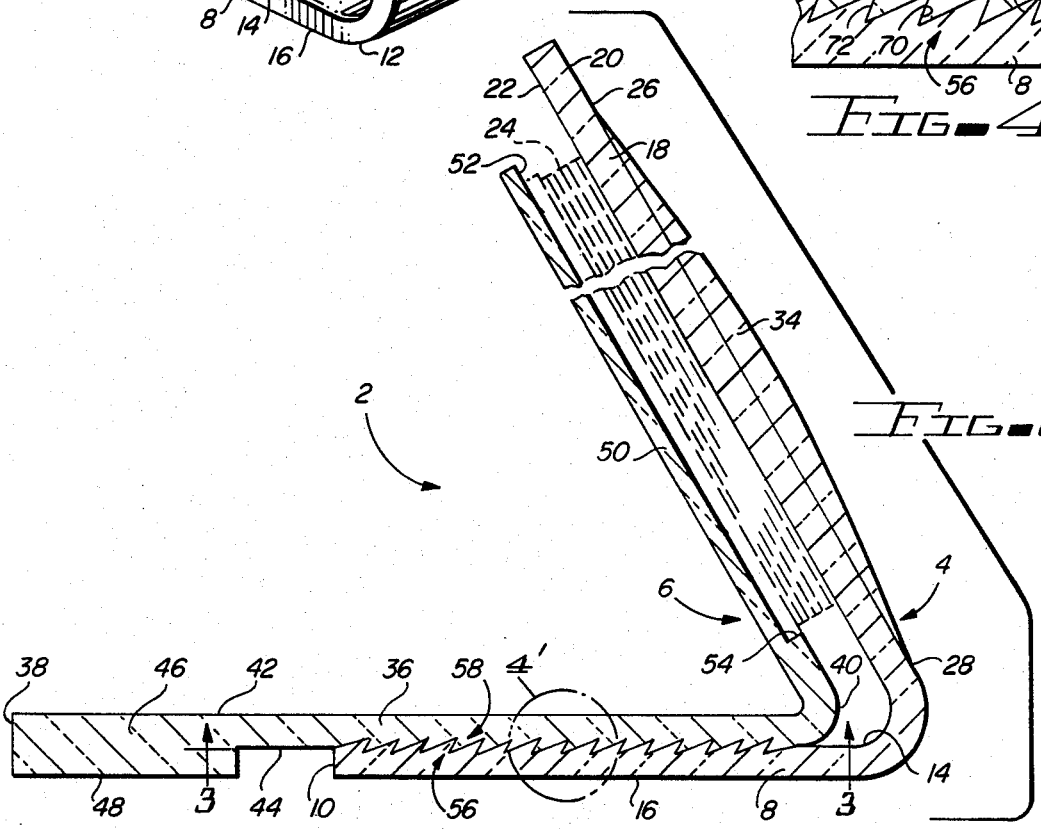
FIG-2

ADJUSTABLE BOOK HOLDER INCLUDING MAGNIFYING FRONT PANEL

BACKGROUND OF THE INVENTION

1. Field of the Invention

The present invention relates generally to book stands used to support an opened book in an elevated, angled position upon a table or other supporting surface and more particularly, to a book holder that is easily adjustable to account for books of different thicknesses and which magnifies the printed matter appearing upon the exposed pages of the book.

2. Description of the Prior Art

Book stands used to support a book in an opened position are well known in the art. Many of such prior art book stands are in the form of an easel for supporting the lower edge and back side of the opened book without engaging the exposed pages of the opened book. While such easel-type book stands are generally useful for supporting older, used books which have been opened and read on several occasions, newer less-used books exhibit a tendency to close upon themselves due to the initial stiffness of the binding used to hold the book together. Such easel-type book stands are generally not adapted to maintain a newer book opened to a particular page.

In addition, simple easel-type book stands do not protect the opened pages of the book from being splattered by foreign matter. For example, if the book stand is being used in the kitchen to support a cookbook, the exposed pages of the cookbook often become soiled and stained by cooking splatters, thereby detracting from the appearance and useful life of the cookbook. Other environments wherein it may be desirable to protect the exposed pages of the opened book from being soiled or damaged include scientific laboratories and automotive garages.

To overcome the aforementioned disadvantages of simple easel-type book stands, book holders including a transparent front panel for overlying the exposed pages of the opened book have been proposed in the art. For example, U.S. Pat. No. 3,762,675 issued to Sankey discloses a cookbook stand having a transparent front panel supported in an inclined position by a pair of hinged mounting brackets. The mounting brackets each include a horizontal leg portion for supporting the lower edge of the book and an upwardly extending wing member to support the back of the book. The hinged mounting brackets are movable between open and folded positions.

In addition, U.S. Pat. No. 3,809,352 issued to Mathias discloses a book holder including a transparent holding and viewing panel overlying the exposed pages of the book and spaced apart from a book supporting panel used to support the back of the book. The transparent viewing panel and book supporting panel are joined at the lower ends thereof by a ledge which supports the lower end of the book. A bracing panel extends rearwardly and downwardly from the book supporting panel to maintain the same at an angle relative to a table top or other supporting surface. The upper edges of the transparent viewing panel and book supporting panel are spaced more closely than the bottom edges thereof for, to some extent, accommodating books of different thicknesses.

However, book holders of the type disclosed by Sankey and Mathias are subject to various drawbacks. For example, the book stand disclosed by Sankey has a fixed width channel formed between the transparent panel and the wing members and is therefore incapable of accommodating papers and books of a wide variety of thicknesses. Furthermore, because the wing members are spaced apart from one another, the book stand is not adapted to hold either papers of a width less than the distance between such wing members or papers which are relatively flexible and which may therefore bend and fall rearwardly through such wing members. In addition, the hinged construction of the mounting brackets results in relatively high manufacturing costs. In regard to the book holder described by Mathias, while some provision has been made for accommodating books of different thicknesses, the range of such permissible thicknesses is relatively limited. Moreover, it is somewhat difficult to insert thicker books into the holder disclosed by Mathias due to the need to pull the upper edge of the transparent panel away from the upper edge of book supporting panel to allow the book to enter the channel formed therebetween. In addition, no prior art book stands or holders of which the present applicant is aware provide any means for magnifying the printed matter appearing upon the exposed pages of the opened book.

Accordingly, it is an object of the present invention to provide a holder for supporting a book or the like in an opened position while protecting the exposed pages of the opened book from splattering, stains or other damage.

It is another object of the present invention to provide such a holder which is equally adapted to support a single sheet of paper containing written or printed matter thereon.

It is still another object of the present invention to provide such a book holder which is adapted to accommodate books and papers of a wide variety of thicknesses.

It is a further object of the present invention to provide such a book holder into which books or papers may be easily inserted and wherein the book holder may be quickly and conveniently adjusted to suit the thickness of the particular book or paper after the same has been inserted into the book holder.

It is a still further object of the present invention to provide such a book holder which includes a means for magnifying the written or printed matter appearing upon the exposed pages of the book or paper held thereby.

It is yet a further object of the present invention to provide such a book holder which may be produced easily and inexpensively.

These and other objects of the present invention will become more apparent to those skilled in the art as the description thereof proceeds.

SUMMARY OF THE INVENTION

Briefly described, and in accordance with one embodiment thereof, the present invention relates to a holder for supporting a book or the like in an opened position and including a front member having a horizontal base portion and a transparent support panel extending upwardly and rearwardly from the front end of the horizontal base portion. The book holder also includes a rear member having a horizontal base portion as well as a support panel extending upwardly and rearwardly from the front end of the base portion of the rear member. The lower surface of the base portion of the front member is adapted to engage and rest upon a generally horizontal support surface, such as a table top or the like. The lower surface of the base portion of the rear member is adapted to rest upon the upper surface of the base portion of the front member for positioning the support panel of the arear member generally parallel to and behind the support panel of the front member. The book or other article to be supported by the holder is inserted between the support panels of the front and rear members, the front surface of the support panel of the rear member supporting the covers of the opened book and the rear surface of the support panel of the front member engaging the exposed pages thereof. The book holder further includes a positioning mechanism for adjustably positioning the base portion of the rear member at a predetermined position upon the upper surface of the base portion of the front member to maintain the support panels of the front and rear members spaced apart by a predetermined distance commensurate with the thickness of the opened book or other article to be supported by the holder.

In the preferred embodiment of the present invention, the aforementioned positioning mechanism is provided by a pair of opposing toothed racks formed upon the upper surface of the base portion of the front member and the lower surface of the base portion of the rear member. The opposed pair of toothed racks releasably engage and interlock with one another for adjustably maintaining the rear member in a predetermined position with respect to the front member. The distance between the support panels of the front and rear members may be adjusted in increments corresponding to the distance between successive teeth within each of the pair of opposed toothed racks. Preferably, the teeth within the toothed rack formed upon the upper surface of the front member base portion are directed generally toward the front end thereof while the teeth within the toothed rack formed upon the lower surface of the rear member base portion are directed generally toward the rear end thereof to facilitate sliding motion of the rear member toward the front member while opposing sliding motion of the rear member away from the front member. The support panel of the rear member includes a lip projecting forwardly from the front surface thereof for engaging the bottom edge of the book and thereby causing the entire weight of the book to be borne by the rear member to help maintain the toothed racks in engagement with one another.

The front surface of the transparent support panel of the front member is formed to have a generally convex shape when viewed in cross-section for magnifying the written or printed matter appearing upon the exposed pages of the book or article inserted within the book holder. The front and rear members may each be formed as one-piece, plastic structures, thereby allowing the present book holder to be manufactured relatively easily and inexpensively.

BRIEF DESCRIPTION OF THE DRAWINGS

FIG. 1 is a perspective view of a book holder constructed according to the teachings of the present invention.

FIG. 2 is a side view of the book holder shown in FIG. 1 and illustrates the manner in which a book is held thereby.

FIG. 3 is a bottom view of a toothed rack formed within the lower surface of the base portion of the rear member of the book holder, as indicated by lines 3—3 shown within FIG. 2.

FIG. 4 is an enlarged view of the area enclosed within the dashed bubble 4 within FIG. 2.

DETAILED DESCRIPTION OF THE PREFERRED EMBODIMENT

The book holder shown in FIGS. 1 and 2 is designated generally by reference numeral 2 and includes a front member 4 and a rear member 6. Front member 4 includes a generally horizontal base portion 8 having a rear end 10 and a front end 12 opposite thereto, while extending approximately six to eight inches in length. Base portion 8 includes an upper surface 14 as well as a lower surface 16. Lower surface 16 is adapted to engage and rest upon a generally horizontal support surface, such as a table top, desk, or counter upon which the book or other article to be read is to be located.

Front member 4 also includes a support panel 18 which extends upwardly and rearwardly from front edge 12 of horizontal base portion 8. Preferably, support panel 18 extends at an angle of approximately 60 degrees from horizontal base portion 8 and extends for approximately 10 to 12 inches in length, while having a width of approximately 12 inches. Support panel 18 includes a front surface 20 and a rear surface 22. Rear surface 22 is adapted to engage the exposed pages of an opened book, as shown within FIG. 2 wherein dashed lines 24 designate the outline of a book supported by book holder 2. Support panel 18 is made of a transparent material to allow the exposed pages of book 24 to be viewed by the user while protecting such exposed pages from cooking splatters, water, chemicals, grease, or other foreign matter.

Still referring to FIGS. 1 and 2, front surface 20 of support panel 18 includes a central rectangular area indicated by lines 26, 28, 30, and 32 defining a magnification lens 34 having a generally convex front surface when viewed in cross-section for magnifying the written or printed matter appearing upon the exposed pages of book 24. Magnification lens 34 allows the user to view the exposed pages of the book more easily, and, if necessary, at greater distances than would otherwise be possible.

Rear member 6 also includes a generally horizontal base portion designated by reference numeral 36 including a rear end 38 and a front end 40 opposite thereto. Base portion 36 also includes an upper surface 42 as well as a lower surface 44. As will be explained in greater detail below, lower surface 44 of base portion 36 is adapted to rest upon upper surface 14 of base portion 8. As shown in FIGS. 1 and 2, rear member 6 may also include a heel 46 disposed proximate the rear end 38 of base portion 36 and extending downwardly beyond lower surface 44 by a distance commensurate with the thickness of base portion 8 of front member 4 to cause the bottom 48 of heel 46 to be essentially coplanar with lower surface 16 of base portion 8, thereby allowing heel portion 46 to engage and rest upon the generally horizontal support surface engaged by lower surface 16.

Rear member 6 also includes a support panel 50 which extends for a distance of approximately eight inches upwardly and rearwardly from front edge 40 of base portion 36 and generally parallel to support panel 18 of front member 4. The width and angle of inclination of support panel 50 are substantially equal to that of support 18. Support panel 50 includes a front surface 52 for engaging and supporting the covers of the open book, or alternatively, the back side of the paper or papers being supported. A horizontal lip 54 extends forwardly from front surface 52 proximate the lower end of support panel 50 for engaging and supporting the lower edge of book 24 as shown in FIG. 2.

To accommodate books and papers of varying thicknesses, the book holder of the present invention is provided with a positioning mechanism for adjustably positioning base portion 36 of rear member 6 upon the upper surface of base portion 8 of front member 4; the positioning mechanism maintains support panel 50 at a predetermined distance from support panel 18 in accordance with the thickness of the particular opened book or papers to be supported by the book holder. In the preferred embodiment of the present invention, this positioning mechanism includes a first toothed rack formed upon upper surface 14 of base portion 8 and a second toothed rack 58 formed upon the lower surface 44 of base portion 36.

As shown in FIG. 3, toothed rack 58 extends continuously between the opposing side edges 60 and 62 of base portion 36, and the tips of each of the teeth within toothed rack 58 extend parallel to one another and perpendicular to side edges 60 and 62. Similarly, toothed rack 56 extends continuously between the opposing side edges of base portion 8, and the tips of the teeth within toothed rack 56 extend parallel to one another and perpendicular to the opposing side edges of base portion 8. As illustrated in FIGS. 1 and 2, toothed rack 56 and toothed rack 58 are adapted to releasably engage and interlock with one another for adjustably maintaining support panel 50 spaced apart from support panel 18. Referring briefly to the enlarged drawing of FIG. 4, the distance between two successive teeth 64 and 66 is designated by reference numeral 68. The distance represented by reference numeral 68 corresponds to the increment by which the distance between support panels 18 and 50 may be varied to account for books of different thicknesses. In the preferred embodiment of the present invention, this incremental distance is approximately one-eighth inch to three-sixteenths inch.

Still referring to FIG. 4, those skilled in the art will appreciate that the teeth comprising the toothed rack 56 formed upon the upper surface of base portion 8 are directed generally toward the front end of base portion 8, while the teeth comprising tooth rack 58, such as teeth 70 and 72, are directed generally toward the rear end of base portion 36. In the preferred embodiment of the present invention, the teeth within each of the toothed racks is set at approximately a twenty-five degree angle to the vertical as indicated by the angle within FIG. 4 designated by reference numeral 74. In this manner, sliding motion of base portion 58, and hence support panel 50, toward support panel 18 of front member 4 is permitted, while sliding motion in the opposite direction is opposed. Accordingly, when a user is preparing to insert a book or other article within the present book holder, the user initially positions support panel 50 apart from support panel 18 by a distance which is greater than the thickness of the book, hence allowing convenient insertion of the book. After the lower edge of book 24 is seated upon lip 54, the user slides base portion 36 in the forward direction until the exposed pages of the book are securely engaged by rear surface 22 of support panel 18. Due to the presence of lip 54, the full weight of book 24 is borne by support panel 50 and is transferred to base portion 36 to aid in maintaining toothed rack 58 in engagement with toothed rack 56 and opposing rearward movement of base portion 36 relative to base portion 8.

Front member 4 and rear member 6 of book holder 2 may each be formed as a single, continuous structure wherein the front end of the associated base portion and the lower end of the associated support panel are joined to one another at a bend. Front member 4 and rear member 6 may be formed of an inexpensive transparent plastic material and may be formed by conventional molding and/or milling processes.

Those skilled in the art will now appreciate that the present invention provides a book holder for supporting books, papers, or the like in an open position while shielding the exposed pages of the book or other article being held. In addition, the book holding of the present invention magnifies the written or printed matter appearing upon the exposed pages for more convenient viewing thereof. The toothed racks formed upon the base portions of the front and rear members of the book holder allow the front and rear supporting panels of the book holder to be spaced apart by a widely varying distance while permitting adjustment of such distance in convenient increments to accommodate books and papers of almost any thickness. The book holder described herein is convenient to use, and when not in use, may be collapsed into a relatively compact structure merely by sliding rear member 6 toward front member 4. Further, the present book holder is relatively easy and inexpensive to produce.

While the present invention has been described with reference to a preferred embodiment thereof, the description is for illustrative purposes only and is not to be construed as limiting the scope of the invention. Various modifications and changes may be made by those skilled in the art without departing from the true spirit and scope of the invention as defined by the appended claims.

I claim:

1. A holder for supporting a book or the like in an opened position, comprising in combination:

a. a front member including a first generally horizontal base portion having front and rear ends and upper and lower surfaces, the lower surface of said base portion being adapted to engage and rest upon a generally horizontal support surface, said front member also including a first support panel portion extending upwardly and rearwardly from the front edge of said first base portion and including front and rear surfaces, the rear surface of said first support panel portion being adapted to engage the exposed pages of the opened book, said first support panel portion being substantially transparent for permitting the exposed pages of the opened book to be viewed by the user while protecting such exposed pages from foreign matter;

b. a rear member including a second generally horizontal base portion having a front and rear ends and upper and lower surfaces, the lower surface of said second base portion being adapted to rest upon the upper surface of said first base portion, said rear member also including a second support panel portion having a front surface and extending upwardly and rearwardly from the front edge of said second base portion and generally parallel to said first support panel portion for supporting the covers of the opened book; and c. positioning means for adjustably positioning the lower surface of said second base portion at a predetermined position upon the upper surface of said first base portion to maintain said second support panel portion by a predetermined distance commensurate with the thickness of the opened book to be supported by said holder; said positioning means comprising:

a. a first toothed rack formed upon the upper surface of said first base portion; and b. a second toothed rack formed upon the lower surface of said second base portion to releasably engage and interlock with said first toothed rack for adjustably maintaining said second support panel portion spaced apart from said first support panel portion by adjustable increments as determined by the distance between successive teeth within each of said first and second toothed racks; said first toothed rack includes a plurality of teeth directed generally toward the front end of said first base portion and said second toothed rack includes a plurality of teeth directed generally toward the rear end of said base portion to facilitate sliding motion of said rear member toward said front member while opposing sliding motion of said rear member away from said front member.

2. A holder as recited by claim 1 wherein said second support panel portion includes a generally horizontal lip extending forwardly from the front surface thereof proximate said second base portion for engaging and supporting a lower edge of the book supported by said holder, said lip bearing the weight of the book and thereby aiding in maintaining said second toothed rack interlocked with said first toothed rack.

3. A holder as recited by claim 1 wherein the front surface of said first support panel portion has a generally convex shape when viewed in cross-section for magnifying printed matter appearing upon the exposed pages of the opened book supported by said holder.

4. A holder as recited by claim 1 wherein said first support panel portion includes means for magnifying printed matter appearing upon the exposed pages of the opened book supported by said holder.

5. A holder as recited by claim 1 wherein said rear member further includes a heel portion disposed at the rear end of said base portion and extending downwardly beyond the lower surface of said base portion by a distance commensurate with the distance between the upper and lower surfaces of said first base portion for allowing said heel portion to engage and rest upon the generally horizontal support surface engaged by the lower surface of said first base portion.

6. A holder as recited by claim 1 wherein:

a. said first base portion and said first support panel portion of said front member are formed as a single, continuous structure; and b. said second base portion and said second support panel portion of said rear member are formed as a single, continuous structure.

7. A holder as recited by claim 6 wherein said front and rear members are each formed of molded plastic.

* * * * *